US010233652B1

(12) United States Patent
Hogan

(10) Patent No.: US 10,233,652 B1
(45) Date of Patent: Mar. 19, 2019

(54) INDIVIDUAL LOCKING WALL PANEL SYSTEM

(71) Applicant: Alply Insulated Panels, LLC, Litchfield, IL (US)

(72) Inventor: Jerry C. Hogan, Pelham, AL (US)

(73) Assignee: Alply Insulated Panels, LLC, Litchfield, IL (US)

( * ) Notice: Subject to any disclaimer, the term of this patent is extended or adjusted under 35 U.S.C. 154(b) by 0 days.

(21) Appl. No.: 15/458,623

(22) Filed: Mar. 14, 2017

Related U.S. Application Data

(60) Provisional application No. 62/307,634, filed on Mar. 14, 2016.

(51) Int. Cl.

| | |
|---|---|
| ***E04B 5/02*** | (2006.01) |
| ***E04B 2/82*** | (2006.01) |
| ***E04F 13/26*** | (2006.01) |
| ***E04F 13/076*** | (2006.01) |
| ***E04F 13/12*** | (2006.01) |
| *E04B 1/343* | (2006.01) |
| *E04B 5/10* | (2006.01) |

(52) U.S. Cl.
CPC ..... *E04F 13/26* (2013.01); *E04F 13/076* (2013.01); *E04F 13/12* (2013.01); *E04B 1/34315* (2013.01); *E04B 5/02* (2013.01); *E04B 5/10* (2013.01)

(58) Field of Classification Search
CPC ..... E04F 13/026; E04F 13/076; E04F 13/12; E04B 2001/1984; E04B 2001/1981; E04B 2001/199; E04B 2001/2481; E04B 2001/2484; E04B 1/34315; E04B 1/34321; E04B 1/40; E04B 9/10; E04B 5/14; E04B 5/02; E04B 5/10; E04B 5/90; E04B 2/82; E04B 2/18; E04B 2/08
See application file for complete search history.

(56) References Cited

U.S. PATENT DOCUMENTS

| | | | | |
|---|---|---|---|---|
| 3,734,550 A | | 5/1973 | Vance | |
| 4,021,987 A | * | 5/1977 | Schnebel | E04B 2/96 52/235 |
| 4,070,835 A | * | 1/1978 | Reverend | E04F 13/0808 52/126.1 |
| 4,570,401 A | * | 2/1986 | Uebel | E04F 13/0855 52/235 |
| 4,607,471 A | | 8/1986 | Olsen | |
| 4,622,794 A | | 11/1986 | Geortner | |
| 4,665,662 A | * | 5/1987 | Swanborn | E04F 13/0826 52/235 |
| 4,756,132 A | | 7/1988 | Newman et al. | |
| 4,768,321 A | * | 9/1988 | Crandell | E04F 13/0808 52/235 |
| 4,866,896 A | | 9/1989 | Shreiner et al. | |
| 5,212,914 A | | 5/1993 | Martin et al. | |

(Continued)

*Primary Examiner* — Phi D A
(74) *Attorney, Agent, or Firm* — Grace J. Fishel

(57) ABSTRACT

A wall panel system for finishing a wall or ceiling with a panel frame extrusion for joining the panel face and panel back skin of the panels. The panel frame extrusion has a keyway into which key anchors are received in latched and unlatched orientation. When the key anchors along adjacent sides of a panel are in latched orientation and the key anchors along the other sides are in unlatched orientation, the panels may be arranged such that a panel in a row and column may be removed without replacing the surrounding panels.

4 Claims, 5 Drawing Sheets

(56) References Cited

U.S. PATENT DOCUMENTS 5,226,274 A * 7/1993 Sommerstein ..... E04F 13/0805 52/509
5,678,383 A * 10/1997 Danielewicz ..... E04D 3/06 52/235
5,829,216 A * 11/1998 Newcomb ..... E04F 13/0807 52/167.1
6,035,598 A 3/2000 Sukolics et al.
6,170,214 B1 1/2001 Treister et al.
6,272,812 B1 * 8/2001 Richardson ..... E04D 3/08 52/200
6,360,498 B1 * 3/2002 Westphal ..... E06B 1/6007 52/204.1
6,484,465 B2 11/2002 Higgins
6,748,709 B1 6/2004 Sherman et al.
7,416,772 B2 * 8/2008 Rinehart ..... B32B 17/10036 428/99
7,472,521 B2 * 1/2009 Bilge ..... E04F 13/0814 52/235
7,596,911 B2 * 10/2009 Turco ..... E04F 13/0889 52/127.6
7,716,891 B2 * 5/2010 Radford ..... E04F 13/0805 52/235
7,810,289 B2 10/2010 Montgomery
7,854,099 B2 12/2010 Kidd
8,033,066 B2 10/2011 Griffiths
8,127,507 B1 3/2012 Bilge
8,166,716 B2 5/2012 Macdonald et al.
8,240,099 B2 8/2012 Hummel, III
8,261,499 B2 9/2012 Boyer et al.
8,347,577 B2 1/2013 Aboukhalil
8,474,202 B2 7/2013 Boyer et al.
8,555,577 B2 10/2013 Maday et al.
8,640,402 B1 * 2/2014 Bilge ..... E04D 3/405 136/251
8,745,941 B2 6/2014 Macdonald et al.
9,080,331 B2 7/2015 Aboukhalil
9,091,079 B2 7/2015 Wright
9,169,653 B2 * 10/2015 Porter ..... E04F 13/08
9,464,441 B2 * 10/2016 Wright ..... E04F 13/0816
9,631,373 B2 * 4/2017 Loyd ..... E04F 13/25
9,695,597 B2 * 7/2017 Wagner ..... E04F 13/0821
2007/0119105 A1 5/2007 MacDonald et al.
2010/0186343 A1 7/2010 MacDonald et al.
2015/0308123 A1 * 10/2015 Prica ..... E04F 13/0801 52/483.1

* cited by examiner

INDIVIDUAL LOCKING WALL PANEL SYSTEM

BACKGROUND OF THE INVENTION

Field of the Invention

The present invention relates to a metal wall panel system for finishing a wall or ceiling with prefabricated architectural panels attached to an underlying structure with key anchors so that individual panels can be easily released and replaced and the starting location for hanging the panels is optional.

Brief Description of the Prior Art

Prefabricated metal panels are well known in the art and are useful particularly for finishing the exteriors of commercial and industrial buildings. One type of exterior wall panel system is composed of two thin aluminum skins laminated to a plastic core. Similar metal panels are formed from steel, stainless steel and copper. The composite metal panels are generally rectangular and are arranged side-by-side in rows and columns and in relatively closely spaced relation starting at a bottom row which is locked in place with a retaining system. The process is repeated until the desired height is achieved which requires that the installation must be sequential, i.e., the starting location for hanging the panels is not optional. Another problem with prior art metal wall panel systems is that if a panel is damaged and needs to be replaced, the retaining system requires that the surrounding panels along a row or column must be removed to reach the panel that needs to be replaced.

BRIEF SUMMARY OF THE INVENTION

In view of the above, it is an object of the present invention to provide a wall panel system that makes replacement of a damaged prefabricated metal panel relatively easy. Another object is to provide a wall panel system which provides the installer flexibility in the starting location for hanging the panels. Other objects and features of the invention will be in part apparent and in part pointed out hereinafter.

In accordance with the invention, a wall panel system for finishing a wall or ceiling makes use of a panel frame extrusion for joining the panel face and panel back skin. The panel frame extrusion has a keyway into which key anchors may be received in latched and unlatched orientation. When the key anchors along adjacent sides of a panel are attached to an underlying building grid in latched orientation and the key anchors along the other sides are in unlatched orientation, a panel in a row and column may be removed without replacing the surrounding panels.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

The following detailed description is merely exemplary in nature and is not intended to limit the described embodiments or the application and uses of the described embodiments.

Figure 1:
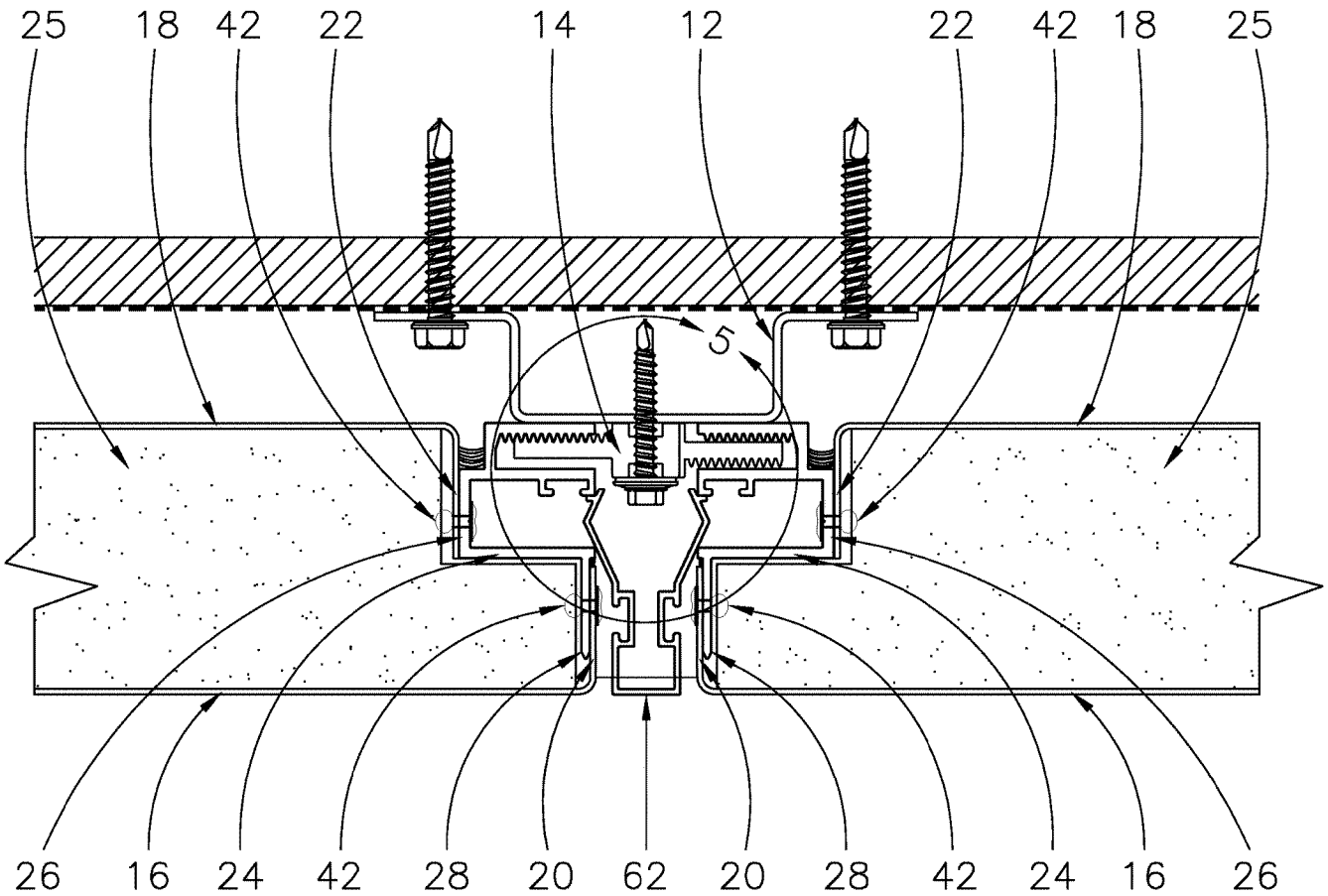
FIG. 1 is a cross-section showing wall panels connected with key anchors received into a panel frame extrusion joining the panel face and panel back skin of the panels.
Figure 2:
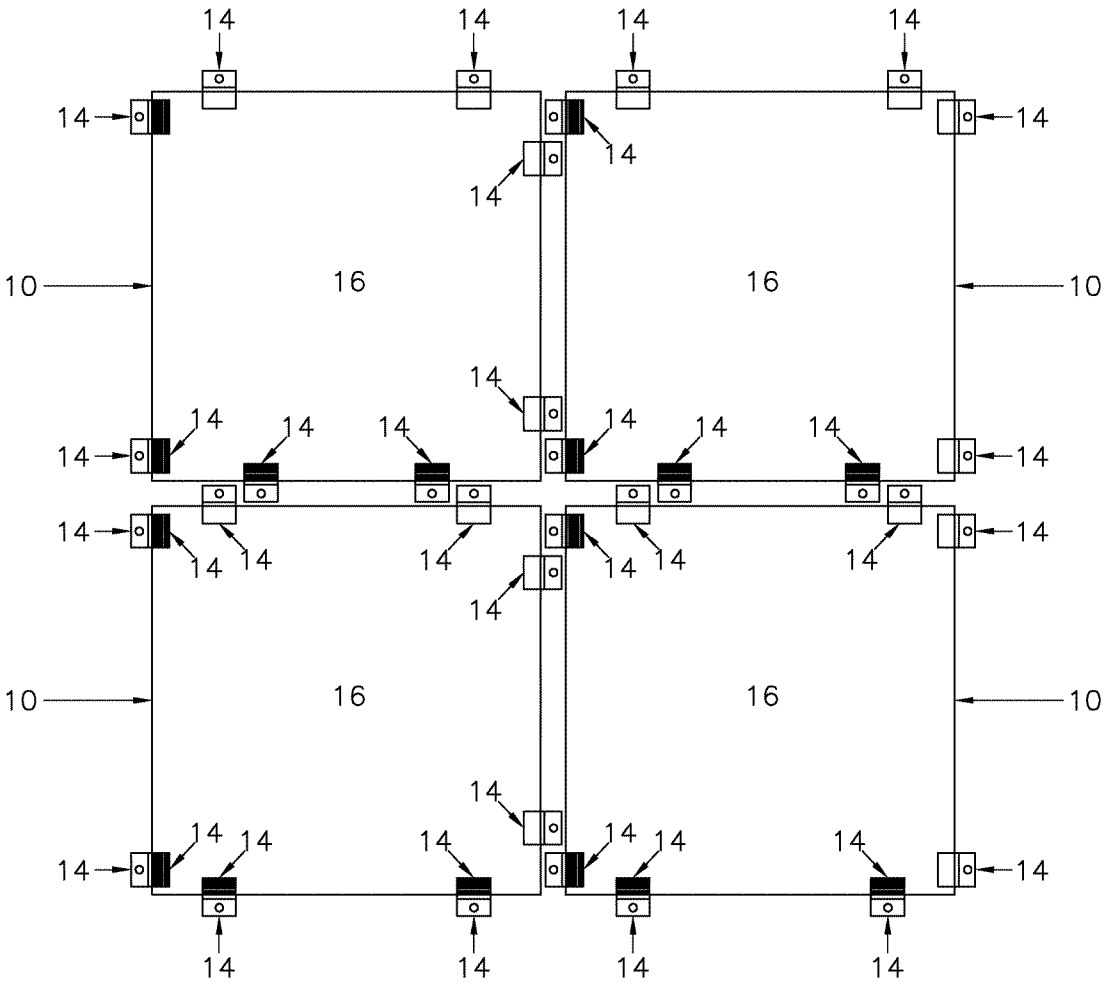
FIG. 2 is a plan view of four panels joined together with key anchors.

Referring to the drawings more particularly by reference character, a wall panel system for finishing a wall or ceiling includes a plurality of panels 10 as shown in FIG. 2 attached to a grid 12 (FIG. 1) with key anchors 14. The wall panel system most frequently is used as an exterior wall cladding but may be adapted for use on non-load bearing interior walls, soffits and ceilings. As best seen in FIG. 1, each panel 10 has a panel face 16 and a panel back skin 18 which are attached along flanged side edges 20, 22, respectively, with a panel frame extrusion 24. The panels are typically rectangular and flat but can be formed in a variety of custom three-dimensional shapes. A plastic core 25 formed of isocyanurate, cellular polystyrene or the like is sandwiched between panel face 16 and back skin 18.

Figure 3C:
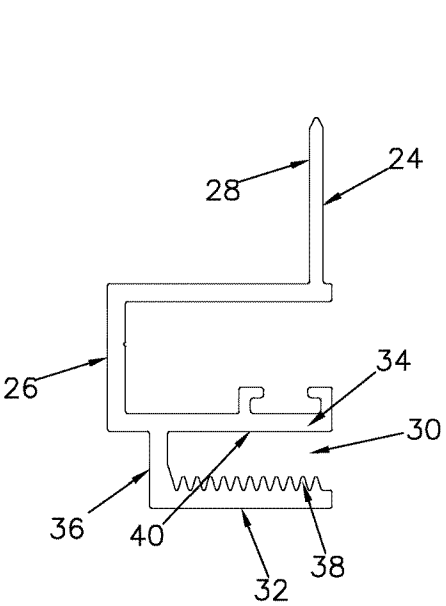
FIG. 3(C) is an end view of the panel frame extrusion.
Figure 3B:
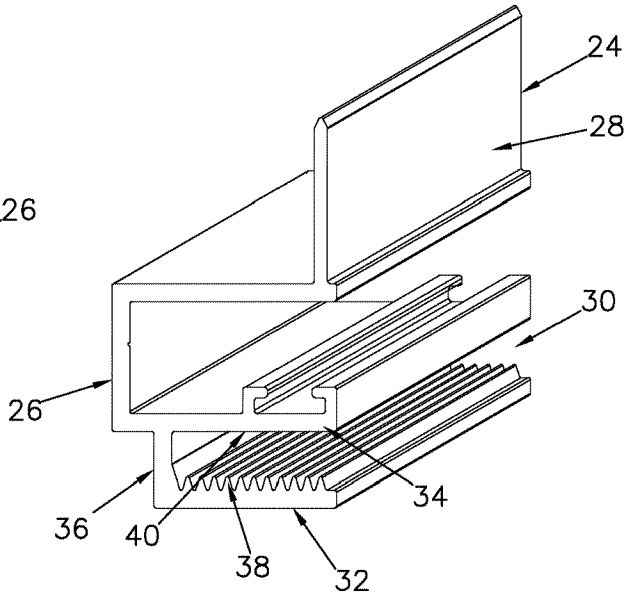
FIG. 3(B) is a perspective view of the panel frame extrusion viewed from a second end.
Figure 3A:
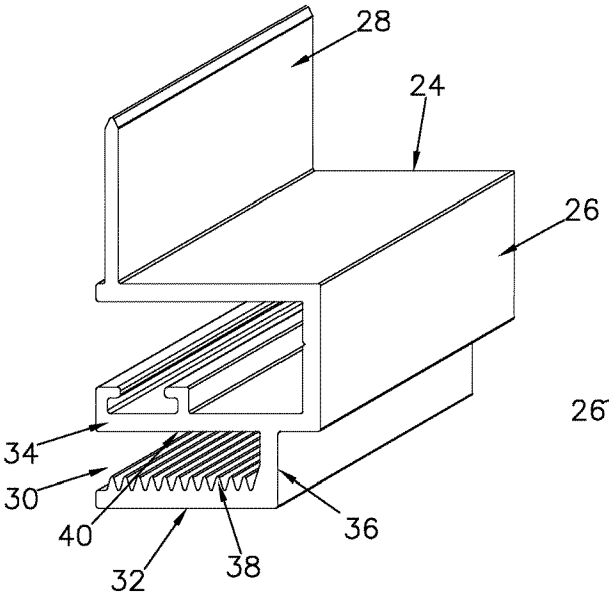
FIG. 3(A) is a perspective view of the panel frame extrusion viewed from a first end.

Turning to FIGS. 3(A)-3(C), panel frame extrusion 24 has a Z-shaped configuration with offset first and second parallel arms 26, 28. A keyway 30 is attached on the end of and perpendicular to first arm 26. Keyway 30 has first and second parallel legs 32, 34 spaced apart on a base 36. First leg 32 has grooves and ridges 38 perpendicular to a long axis of the first leg and second leg 34 has a generally smooth surface 40. Fasteners 42 attach first and second arms 26, 28 of panel frame extrusion 24 to flanges 20, 22 of panel face 16 and panel back skin 18.

Figure 4C:
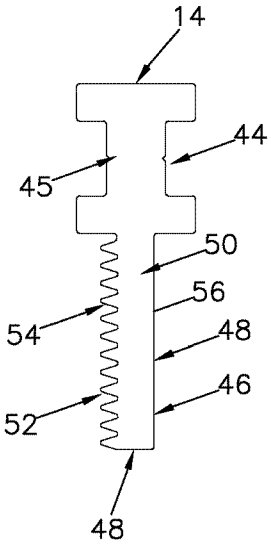
FIG. 4(C) is an side view of the key anchor.
Figure 4B:
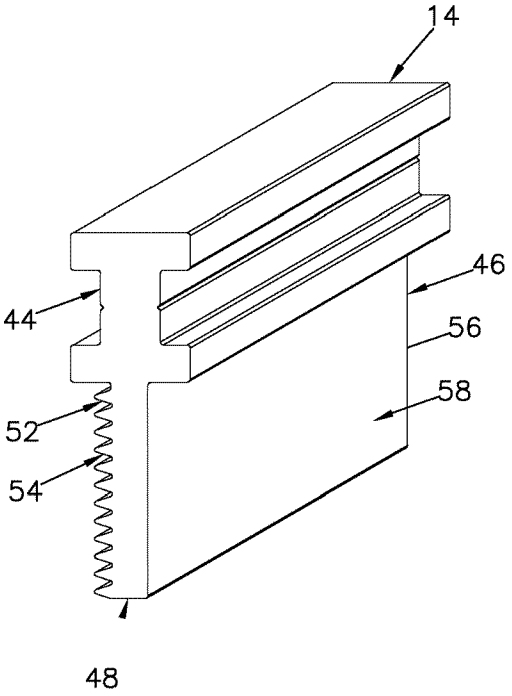
FIG. 4(B) is a perspective view of the key anchor viewed from a second side.
Figure 4A:
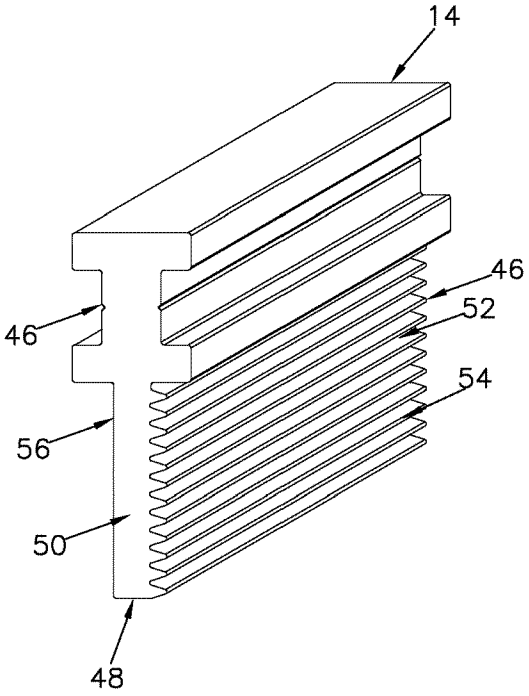
FIG. 4(A) is a perspective view of a key anchor viewed from a first side.

Key anchor 14 as shown in FIGS. 4(A)-4(C) has a head 44 with a hole 45 (FIG. 4(*c*)) by means of which it is attached to grid 12 with a screw 47 (FIG. 5) or other fastener and a blade 46 which is generally rectangular. Key anchors 14 are preferably about 1 inch wide but may be wider or narrower if desired and are customarily spaced on grid 12 at 16" on center intervals. However key anchors 14 may be spaced from 12 to 24 inches on center depending on engineering characteristics of grid 12. Blade 46 has a generally free end 48 and side edges 50. A first cheek 52 of blade 46 has grooves and ridges 54 perpendicular to side edges of blade 46 and a second cheek 56 which is generally smooth 58.

Panel frame extrusion 24 and key anchor 14 are formed of aluminum whereas panel face 16 and back skin 18 may be formed of aluminum, steel, stainless steel, copper or other suitable sheet metal in various thicknesses and with various finishes. For example for exterior wall cladding, panel face 16 may be formed of aluminum 3004 H 14 0.040" with an anodized finish or a Kynar® metallic finish. For interior wall faces, panel face 16 may be formed of aluminum 3004 H 14 0.040" with a Duranar® finish or of 24 gauge galvanized steel ASTM A653 G90. Other metal thicknesses and finishes are of course possible.

Figure 5:
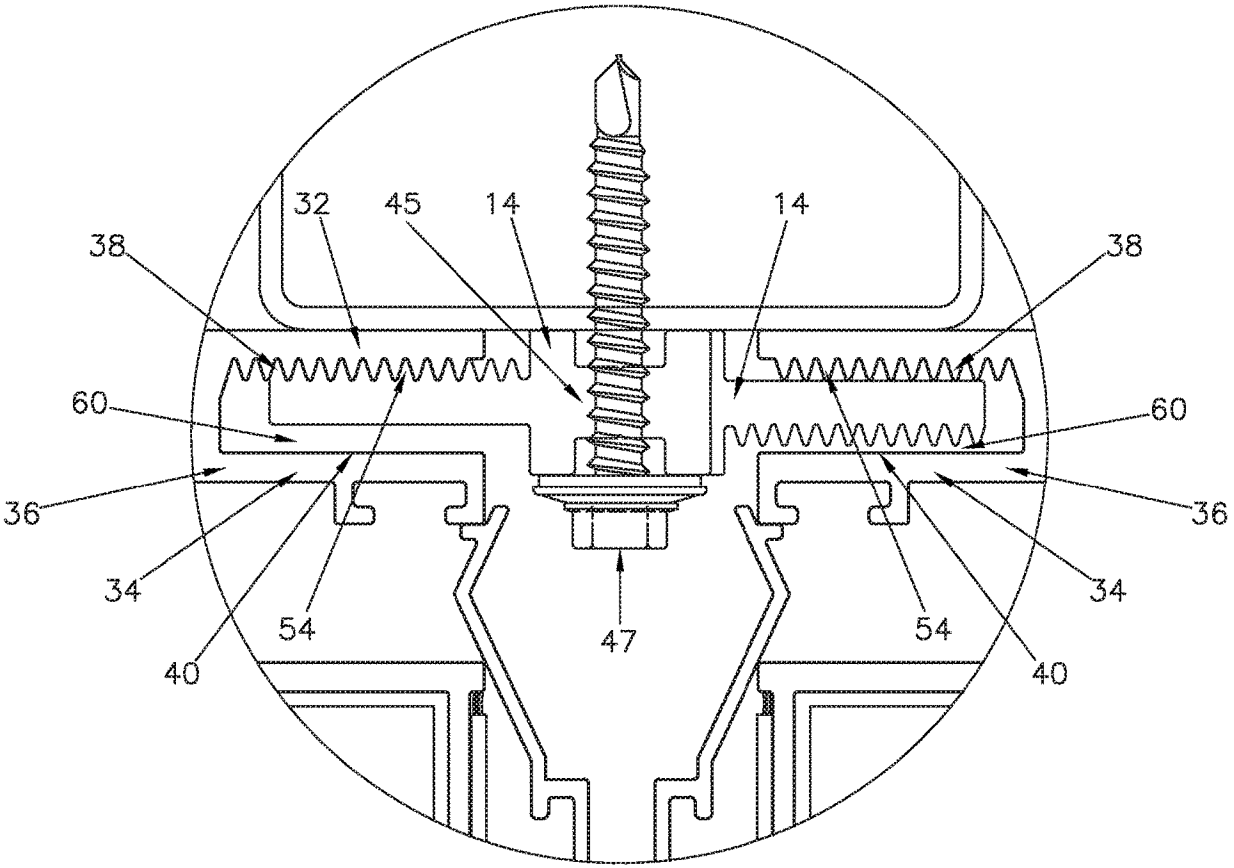
FIG. 5 is a detail on an enlarged scale take along the line 5-5 in FIG. 1.

As best seen in FIG. 5, base 36 of keyway 30 spaces first and second legs 32, 34 such that key anchor 14 is loosely received 60 in keyway 30 with grooves and ridges 38 of key anchor 14 latched into grooves and ridges 54 of keyway 30 in a first orientation and snugly received in keyway 30 with grooves and ridges 38 of key anchor resting on smooth surface 40 of keyway 30 in a second orientation.

In use, at least two key anchors 14 are provided along each side of panels 10. Panels 10 are attached to grid 12 with the key anchors 14 along two adjoining sides in one orientation and the key anchors 14 along the other sides are in an opposite orientation such that the panel may be removed from the grid without removing an adjacent panel. As shown in FIG. 1, the space between panels 10 is filled with an aluminum insert 62 but a gasket, wet seal or the like may be used. Wall or ceiling may be constructed starting at the base or optionally elsewhere.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A wall panel system for finishing a wall or ceiling comprising:

a plurality of panels attached to a grid in a plurality of rows and columns wherein:

each panel has a panel face and a panel back skin which are attached along side edges of the panel with a panel frame extrusion, said panel frame extrusion having a Z-shaped configuration with offset first and second parallel arms attached to the side edges of the panel between the panel face and the panel back skin, a keyway attached perpendicular to the first arm, said keyway having first and second parallel legs spaced apart on a base, said first leg having grooves and ridges perpendicular to the base and a second leg with a generally smooth surface, at least two keys inserted into the keyway of the panel frame extrusion along each side of the panel, each of said keys having a head for attaching the key to the grid in an unlocked first orientation and in a locked second orientation and a blade, said blade being generally rectangular in configuration with a generally smooth free end and side edges, said blade further having a first cheek with grooves and ridges perpendicular to side edges of the blade and a second cheek which is generally smooth, said base of the keyway spacing the first and second legs for engagement of the key in the unlocked first orientation when the key is inserted into the keyway such that the ridges and grooves of the key slide rest on the smooth surface of the second leg and for engagement of the key in the locked second orientation when the key is inserted into the keyway such that the ridges and grooves of the key are received into the ridges and grooves of the keyway, whereby said panels are attached to the grid by a head of the keys of said panel along two adjoining sides in the first orientation and by the head of the keys along the other sides in the second orientation such that the panel may be removed from the grid without removing an adjacent panel.

2. The wall panel system of claim 1 wherein the panel frame extrusion and key are formed from extruded aluminum.

3. The wall panel system of claim 1 wherein the panel face and panel back skin are formed of aluminum, steel, stainless steel or copper.

4. The wall panel system of claim 1 wherein the head of the key has a hole configured for receipt of a screw for attachment of the key to the grid.

* * * * *